United States Patent [19]

McDonald

[11] 4,206,799

[45] Jun. 10, 1980

[54] OBLIQUE CORE LOCKING MECHANISM FOR DIE CASTING MACHINES

[76] Inventor: John W. McDonald, 3664 Indian Rd., Toledo, Ohio 43606

[21] Appl. No.: 967,970

[22] Filed: Dec. 11, 1978

[51] Int. Cl.[2] ..... B22D 17/26

[52] U.S. Cl. ..... 164/341; 164/343; 164/347; 425/451.9; 425/468; 425/556; 425/577; 425/595

[58] Field of Search ..... 164/341-347; 425/468, 577, 593, 451.7, 451.9, 556, 595, DIG. 221

[56] References Cited

U.S. PATENT DOCUMENTS

| | | | |
|---|---|---|---|
| 3,165,796 | 1/1965 | McDonald | 164/341 X |
| 3,339,242 | 9/1967 | Lamb | 425/468 X |
| 3,433,292 | 3/1969 | McDonald | 164/343 |
| 3,596,708 | 8/1971 | Lapin | 164/343 |

*Primary Examiner*—Robert D. Baldwin
*Assistant Examiner*—J. Reed Batten, Jr.
*Attorney, Agent, or Firm*—Marshall & Yeasting

[57] ABSTRACT

A die member in an ejector die assembly is movable obliquely with respect to the axis of movement of the ejector die assembly. Backup plate means is connected to the ejector die assembly by a lost motion connection. The backup plate means locks the die member by direct engagement with the die member in the machine closed position and is moved away from the ejector die assembly in the machine open position to permit withdrawal of the die member from the die cavity.

4 Claims, 4 Drawing Figures

OBLIQUE CORE LOCKING MECHANISM FOR DIE CASTING MACHINES

BACKGROUND OF THE INVENTION

This invention relates to die casting machines having relatively movable die members associated with a movable ejector die assembly, and more particularly to an improved oblique core locking mechanism for use with die casting machines of the type disclosed in U.S. Pat. No. 3,433,292, issued Mar. 18, 1969 in the name of J. W. McDonald.

In the die casting of articles of complex shape, such as engine blocks, a plurality of movable die sections are registered in a die-closed position to form a die cavity, and are subsequently retracted to permit removal of the cast part from the die. These die sections must be held in place in the closed position against extremely high molten metal injection forces, sometimes up to 500,000 to 1,000,000 pounds. Those die parts which are movable in a direction coinciding with the principal or longitudinal direction of movement of the die casting machine are locked in place by the normal opening and closing mechanism of the machine itself. Those die parts which move in a direction parallel to the parting plane, which is perpendicular to the principal axis of the machine, are locked in place during the injection step by wedges or the like protruding from the cover die. Even though substantial force builds up during the metal injection step in die casting, movable die members can be satisfactorily locked in a die-closed position when they move only in these two directions. However, die members which are movable at an acute angle with respect to the longitudinal axis of the die casting machine have been locked in die-closed positions by engagement of a backup plate with the piston rods of the hydraulic cylinder means used for moving the die members, as disclosed in the above U.S. Pat. No. 3,433,292. This locking mechanism has not been satisfactory because the great angular forces acting on the piston rods deleteriously affect the packing of the hydraulic cylinders, and cause rapid wear in the area of contact between the piston ends and the backup plate because of sliding action and relatively small contact area. It has also been unsatisfactory because of limited access to the hydraulic cylinders.

SUMMARY OF THE INVENTION

It is an object of this invention to provide an improved die casting machine.

It is a more specific object of this invention to provide, in a die casting machine having a movable die assembly associated with backup plate means, an improved mechanism by which relatively movable members of the die assembly, disposed at an acute angle even as great as 45° with respect to the longitudinal axis of the machine, are held in place when the machine is in the die-closed position.

It is a still more specific object of this invention to provide, in a die casting machine, angular core locking mechanism which eliminates hydraulic stem loading, pillar and/or column loading, and provides improved access to hydraulic cylinders used for moving the angular cores.

In accordance with the invention these and other objects are accomplished by providing in a die casting machine, an ejector die assembly comprising a plurality of die members at least one of which is movable relative to the die assembly in a direction at an acute angle to the longitudinal axis of the machine, and backup plate means attached to the back side of the ejector die assembly by a lost motion connection. When the machine is in the closed position the die members of the ejector die assembly, including the angularly movable member, register in the die-closed position to define a cavity therebetween. In this position, the backup plate means is held against the opposite (rear) side of the ejector die assembly and against the rear side of the angularly movable die member by the closing mechanism of the machine. The dimensional integrity of the cavity in the die-closed position is thus maintained. The machine is opened by withdrawing the backup plate means to the limit of the lost motion connection and the movable die members are retracted. Further withdrawal of the backup plate means moves the ejector die assembly to the full die-open position.

Other objects and advantages of my invention will be apparent from the complete description which follows.

DESCRIPTION OF THE PREFERRED EMBODIMENT

Figure 1:
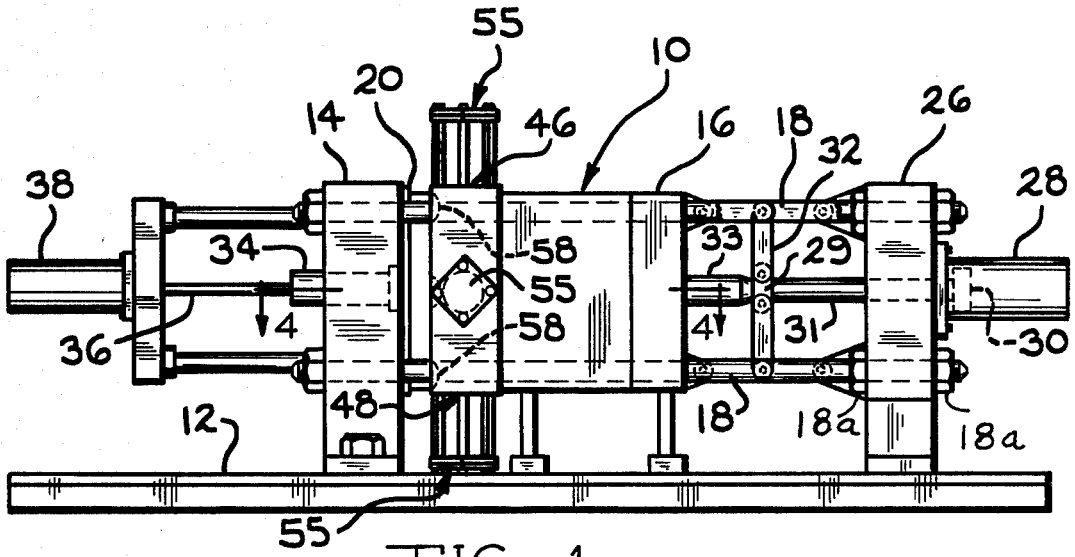
FIG. 1 is a general view of a die casting machine embodying the invention.

Referring to FIG. 1, a die casting machine indicated generally at 10 includes rails 12 on which a stationary platen 14 is supported. A movable platen 16 is slidably supported on the rails 12. A rear stationary platen 26 is secured to the ends of tie bars 18 by means of nuts 18*a*, and is slidably supported on the rails 12 to accommodate slight stretching and contraction of the tie bars 18 during operation of the machine. Tie bars 18 connect the stationary platens 14 and 26, and serve as a guide for the movable platen 16. Attached to the front stationary platen 14 and supported thereby is a cover die holding block 20 on which is mounted a cover die or stationary die 21 shown in FIGS. 2 and 4. The various movable die members comprising an ejector die assembly are associated with and supported by an ejector die holding block 22. The ejector die holding block 22 is slidably supported by the rails 12 and is attached to the movable platen 16 by means of a lost motion connection including mounting rods 24 (see FIG. 2). Movement and lock up of the movable platen 16 and the ejector die holding block 22 are effected by a toggle linkage 32. In a hydraulic closing cylinder 28 fluid pressure is exerted against a piston 30, and the piston 30 transmits the force through a rod 31, cross-head 29, toggle linkage 32 and stop 33 to the movable platen 16.

Figure 4:
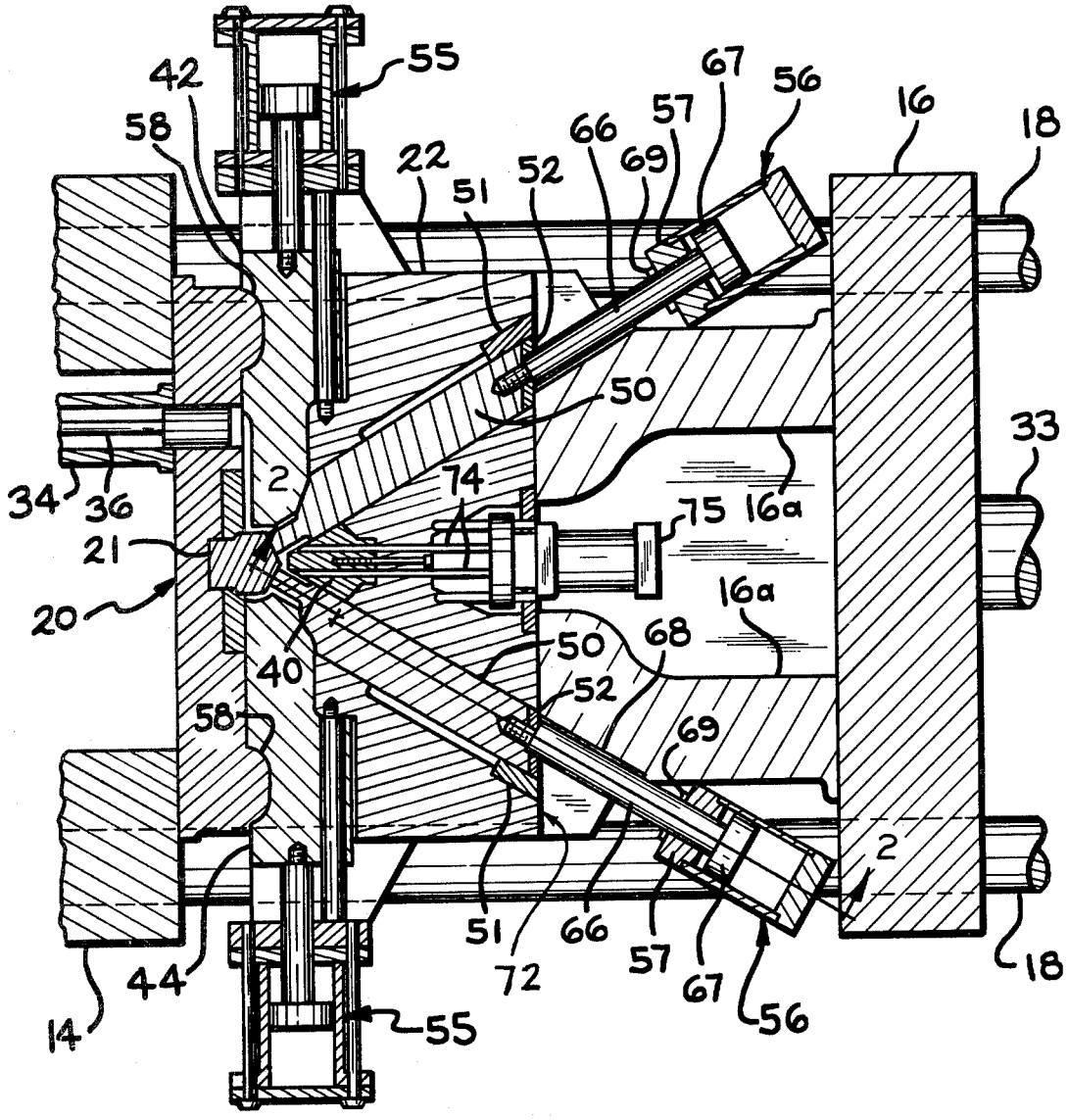
FIG. 4 is a view similar to FIG. 3 except that the dies are shown in the closed position.

At the other end of the machine 10, as seen in FIGS. 1 and 4, molten metal is injected into the cavity formed by the closed dies through a shot sleeve 34 extending through the front platen 14, by means of a shot plunger 36. The shot plunger 36 is actuated by fluid pressure in a hydraulic shot cylinder 38.

Figure 2:
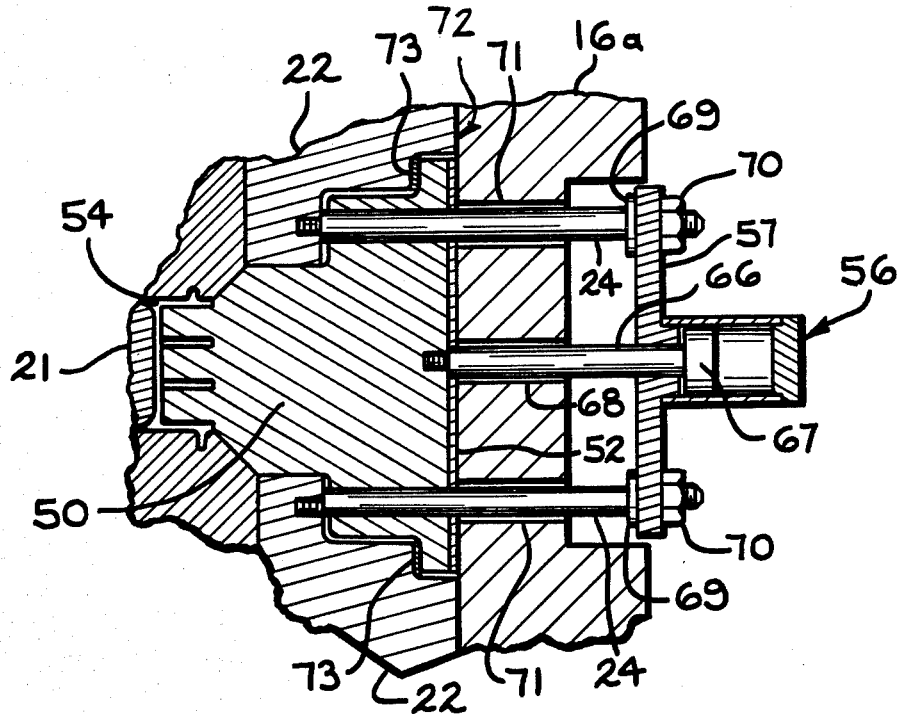
FIG. 2 is a detailed, fragmentary sectional view taken along the line 2—2 of FIG. 4.
Figure 3:
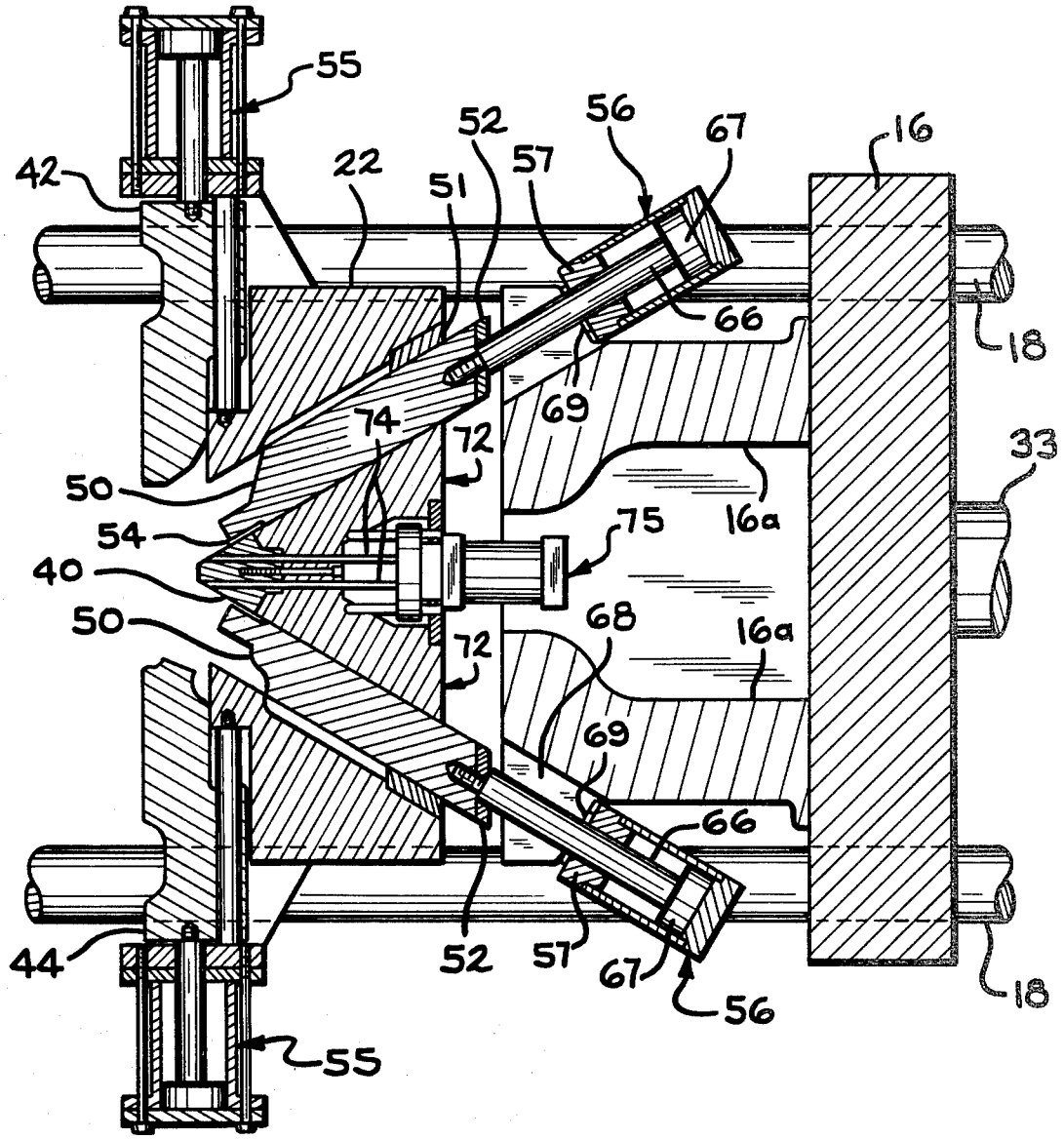
FIG. 3 is a detailed, fragmentary sectional view taken along the line 4—4 of FIG. 1, except that the dies are shown in the open position.

The movable ejector die holding block 22 and the various die members, which are concealed by a dust cover in FIG. 1, are shown in FIGS. 2–4. The ejector die holding block 22 supports an ejector die 40 and slidable die members 42, 44, 46 and 48. Each of these slidable die members 42, 44, 46, 48 is movable in a direction which is perpendicular to the principal axis of the machine and parallel to the parting plane. The ejector die holding block 22 also supports two core members 50 which are movable relative to the rest of the ejector die assembly in a direction at an acute angle with the principal axis of the machine. Wear plates 51 attached to the die holding block 22, against which the core members 50 slide, take appreciable thrust when the die members are locked. These wear plates 51, and wear plates 52 attached to the ends of the core members 50 as lock surfaces, provide relatively large, continuous surfaces, on which the load per unit of area is very small.

When the machine is in the die-closed position as shown in FIGS. 2 and 4, the various die and core members are fully inserted and register to form a die cavity 54, which could assume any desired shape, but which as shown is suitable for the casting of a V-type engine block. In this case the two movable core members 50 are used to form the two cylinder banks of the engine block.

Each of the slidable die members 42, 44, 46, 48 supported by the ejector die holding block 22 is provided with hydraulic cylinder means 55 to advance or withdraw the die member. Hydraulic cylinder means 56 to actuate each of the two core members 50 is attached to a plate 57 which is mounted on rods 24 attached to the ejector die holding block 22, as shown in FIG. 2. Attached to the core members 50 are piston rods 66 which in turn are connected with pistons 67 which are reciprocally operable as part of the respective hydraulic cylinder means 56, to move the core members 50 into and out of the cavity 54. Spacer 16*a*, which functions as part of the movable platen 16, defines two slots 68 through which the piston rods 66 extend and in which the piston rods are movable. Wear plates 69 on the mounting rods 24 protect the plates 57 from engagement with the spacer 16*a* in the position of the spacer 16*a* shown in FIG. 3. The mounting rods 24 have threaded ends screwed into the ejector die holding block 22, and also have shoulders which hold the wear plates 69 against the plates 57 by means of nuts 70. This structure permits the core members 50 to be moved to the left or right as viewed in FIG. 2 by using only the cylinders 56. The mounting rods 24 extend through slots 71 in the spacer 16*a*, and by being threaded into the ejector die holding block 22 form a lost motion connection between the holding block 22 and the movable platen 16, because when the platen 16 and spacer 16*a* move from their position shown in FIG. 4 to their position shown in FIG. 3, further movement of the platen 16 to the right as viewed in FIG. 3 pulls the holding block 22 along with it.

The die members which move in a direction perpendicular to the axis of the machine are suitably locked in die-closed position during the molten metal injection by cover die wedge devices 58 protruding from the surface of the cover die holding block 20. However, other means must be provided to satisfactorily lock up the slidable core members 50. This is provided by so positioning the core members 50 in the ejector die holding block 22 that when the machine is closed the core members are locked by direct contact with the spacer 16*a* carried by the movable platen 16. Yet because there is a lost motion connection between the ejector die holding block 22 and the movable platen 16 there is suitable space, when the machine is opened, for the core members 50 to be completely withdrawn from the die cavity 54.

When the machine is in the die-open position, as shown in FIG. 3, the spacer 16*a* and the ejector die holding block 22 are separated by a distance determined by the length of the mounting rods 24, so that the core members 50 may be withdrawn from the die cavity 54, thus permitting removal of the casting. The lost motion connection between the ejector die holding block 22 and the platen 16 permits the ejector die holding block 22 and the movable spacer 16*a* to be separated by utilizing the moving force transmitted by the hydraulic cylinder 28 through the toggle linkage 32. However, no connection between the movable platen 16 and the ejector die holding block 22 would be required if separate means were provided for moving the holding block 22 between the open and closed positions of the machine.

Referring now to FIGS. 2 and 4, in the closed position of the machine the core members 50 extend into the die cavity 54. When molten metal is charged into the die cavity 54, the hydraulic pressure within the cylinders 56 would not be sufficient to maintain the core members in the cavity. To prevent the core members 50 from being blown out of the cavity, additional supporting means is provided. This is accomplished in the die-closed position of the machine by having the spacer 16*a* bear against a planar bearing surface provided by the wear plates 52 carried by the core members 50, to lock the core members 50 in die-closed position during the injection step of the die casting process. In the die-closed position of the machine, the spacer 16*a* also bears against a planar bearing surface 72 on the ejector die holding block 22 to lock the die 40 in die-closed position during the injection step, and the core members 50 also are forced against wear plates 73 on the holding block 22.

In operation, starting in the die-closed position, molten metal is injected into the die cavity 54 by the shot plunger 36 in the shot cylinder 34. Upon solidification of the metal, the lockup pressure is released by the hydraulic closing cylinder 28, and the platen 16 begins to move in the opening direction, in response to the pulling force transmitted through the toggle mechanism 32. The injection piston 36 follows through for a few inches, forcing the ejector die holding block 22 to remain against the spacer 16*a*. As the platen 16 is further moved toward its die-open position, the ejector die holding block 22 separates from the spacer 16*a* by a distance according to the length of the mounting rods 24, and fluid under pressure is supplied to the hydraulic cylinders 56 provided for the core members 50, acting on the pistons 67 to retract the core members 50 out of the casting. Similar hydraulic cylinders 55 operate to withdraw the die members 42, 44, 46 and 48 from the casting, and the die is now in the die-open position shown in FIG. 3. The casting, which remains adhering to the ejector die 40, is then removed by the use of ejector pins 74 which are actuated by means of a hydraulic cylinder 75.

After removal of the casting, the movable die members 42, 44, 46 and 48 and the core members 50 are returned to the casting position by operation of their respective hydraulic cylinders. The movable platen 16 is pushed toward closing position by force generated within the hydraulic closing cylinder 28 and transmitted through the toggle linkage 32. The spacer 16*a* seats on the bearing surface plates 52 of the core members 50, and the spacer 16*a* is moved against the ejector die holding block assembly to push it into die-closed and locked position against the cover die 21. The machine is now ready for the next injection. The spacer 16*a*, which together with the platen 16 forms a backup plate means, engages the bearing surface plates 52 of the core members 50 and the surface 72 of the ejector die holding block 22 in substantially the same plane.

The spacer 16*a* could be eliminated and the platen 16 itself could be used as the locking member. In such case the hydraulic cylinders 56 for the core members 50 would be located to the right of the platen 16 as viewed in FIG. 3, and suitable slots corresponding to the slots 68 and 71 in the spacer 16*a* would be provided in the platen 16.

In prior die casting machines having die members movable at an acute angle with respect to the longitudinal axis of the machine, a wedge extending from the stationary cover die has been recognized to be an inadequate locking means, as such a die member has an appreciable mechanical advantage against the wedge. Moreover, the hydraulic cylinders which are generally used to impart the necessary reciprocating motion to such a die member are inadequate to lock the member in a die-closed position. Hence, it has been the practice to lock such an angularly movable die member in the ejector die assembly by additional mechanisms not a part of the machine.

The angular core locking mechanism of the invention provides several advantages over the conventional wedges and auxiliary linkages, for example, lower cost dies; less maintenance cost—wedges wear and stick, linkages are bulky and wear; more positive locking, and less downtime for repair.

The angular core locking mechanism of the invention also provides several advantages over the die casting machine shown in the above U.S. Pat. No. 3,433,292. One such advantage as disclosed above is the elimination of hydraulic stem loading and column loading, which are high wear points (high downtime). Such column loading also is disclosed in U.S. Pat. No. 3,165,796, issued Jan. 19, 1965 in the name of J. W. McDonald. Other such advantages are that the present angular core locking mechanism is applicable to any angle V-block (U.S. Pat. No. 3,165,796 most suits 90 degree blocks and U.S. Pat. No. 3,433,292 most suits 60 degree blocks); has less downtime for repair; lower bearing loads—larger surfaces for applying locking force; the present wear plates permit adjustment of preloads with the die in the casting machine under thermal and load conditions; and such wear plates permit compensation for wear with the die in the machine. Even more such advantages are that the spacer 16*a* (or if the spacer 16*a* is eliminated the platen 16) has no projections—the core members 50 can be inserted in the ejector holding block 22 and the assembly milled flat; the present mechanism eliminates any need for additional hydraulic cylinders to accomplish separation between the spacer 16*a* and the ejector holding block 22; and greater preload on core members is possible since the structure is inherently stronger—the core members 50 are very strong in compression.

Various modifications of the above-described embodiment will be apparent to those skilled in the art. It is to be understood that such modifications can be made without departing from the scope of the invention, which should be considered to be limited only by the following claims.

I claim:

1. A die casting machine comprising a stationary platen, an ejector die block which when in engagement with the stationary platen forms a closed die cavity, means for moving the ejector die block toward and away from the stationary platen, and a die member slidably mounted in the ejector die block for movement in a direction at an acute angle to the direction of movement of the block, wherein the improvement comprises:

(a) a substantially planar rear surface on the ejector die block which is perpendicular to the direction of movement of the block, (b) a substantially planar surface on the rear end of the slidable die member, which surface is perpendicular to the direction of movement of the ejector die block, (c) a second platen which is mounted for movement in the same direction as the ejector die block and has a front surface which is engageable with the planar rear surfaces of the ejector die block and slidable die member for locking them in their die-closed positions, (d) a mounting rod fixed to the ejector die block and extending rearward from the ejector die block, (e) means for slidably moving the die member relative to the ejector die block, said means being mounted on the end of the mounting rod, (f) an actuating rod for slidably mounting the die member, which is fixed to the die member and extends rearward from the die member, and which connects the die member to said means for moving the die member, and (g) a slot in the second platen through which the mounting rod extends, and an additional slot in the second platen through which the actuating rod extends, said slots being wide enough to permit the second platen to be moved away from the ejector die block through a distance sufficient to permit the means for slidably moving the die member to withdraw the die member to its die-open position.

2. A die casting machine according to claim 1 wherein (a) the means for slidably moving the die member is supported by a mounting plate secured on the end of the mounting rod, (b) the second platen, upon continued movement away from the ejector die block, is engageable with said mounting plate to move the block away from the stationary platen into its die-open position, and (c) the means for moving the ejector die block toward and away from the stationary platen is connected to move the second platen and thereby move the ejector die block.

3. A die casting machine comprising a stationary platen, an ejector die block which when in engagement with the stationary platen forms a closed die cavity, means for moving the ejector die block toward and away from the stationary platen, and a pair of core members each of which is slidably mounted in the ejector die block for movement in a direction at an acute angle to the direction of movement of the block, wherein the improvement comprises:

(a) a substantially planar rear surface on the ejector die block which is perpendicular to the direction of movement of the block, (b) a substantially planar surface on the rear end of each slidable core member, which surface lies in the same plane as the planar rear surface on the ejector die block when the block and core members are in their die-closed positions, (c) a second platen which is mounted for movement in the same direction as the ejector die block and has a planar front surface which is engageable with the planar rear surfaces of the ejector die block and slidable core members for locking them in their die-closed positions, (d) a pair of mounting rods fixed to the ejector die block and extending rearward from the ejector die block, (e) a hydraulic cylinder for slidably moving each core member, which is mounted on the ends of the mounting rods, (f) each hydraulic cylinder having a piston rod for slidably moving its core member, which is fixed to the core member and extends rearward from the core member, and (g) each piston rod and each mounting rod extending through a slot provided in the second platen, said slots being wide enough to permit the movable platen to be moved away from the ejector die block through a distance sufficient to permit the hydraulic cylinders to withdraw the slidable core members to their die-open positions.

4. A die casting machine according to claim 3 wherein (a) each hydraulic cylinder is supported by a mounting plate secured on the ends of the pair of mounting rods, (b) the second platen, upon continued movement away from the ejector die block, is engageable with said mounting plate to move the block away from the stationary platen into its die-open position, and (c) the means for moving the ejector die block toward and away from the stationary platen is connected to move the second platen and thereby move the ejector die block.

* * * * *